US006058874A

United States Patent [19]

Glenning et al.

[11] Patent Number: 6,058,874

[45] Date of Patent: May 9, 2000

[54] RADIO FREQUENCY COMMUNICATIONS FOR UNDERWATER VEHICLE

[75] Inventors: Daniel M. Glenning, Newport; Michael Visich, Wakefield, both of R.I.

[73] Assignee: The United States of America as represented by the Secretary of the Navy, Washington, D.C.

[21] Appl. No.: 09/113,010

[22] Filed: Jun. 26, 1998

[51] Int. Cl.[7] ..... B63G 8/40

[52] U.S. Cl. ..... 114/328; 114/244; 340/850; 343/709

[58] Field of Search ..... 114/328, 242, 114/244, 249, 251, 253; 340/850; 343/709

[56] References Cited

U.S. PATENT DOCUMENTS 3,972,046 7/1976 Lombardi ..... 343/709

5,377,165 12/1994 LaPointe ..... 114/328

5,379,034 1/1995 O'Connell ..... 114/328

*Primary Examiner*—Stephen Avila

*Attorney, Agent, or Firm*—Michael J. McGowan; James M. Kasischke; Prithvi C. Lall

[57] ABSTRACT

An antenna arrangement for a submerged submarine includes an independently functioning underwater vehicle free of any tethered connection to said submarine, a buoy member having a hydrodynamic shape, an antenna mounted on the buoy member, the antenna enabling collection and transmission of at least global positioning data and radio frequency communications, a releasable connector for securing the buoy member to said underwater vehicle in a primary non-deployed position, and a tether connection the buoy member to the underwater vehicle in a secondary deployed position. Release of the connector deploys the buoy member and the antenna such that the hydrodynamic shape of the buoy member raises the buoy member to a data collection and transmission position at a surface of the water.

13 Claims, 2 Drawing Sheets

RADIO FREQUENCY COMMUNICATIONS FOR UNDERWATER VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a global positioning system (GPS) and radio frequency (RF) communications for underwater vehicles. More particularly, the invention relates to a low cost, highly reliable system for enabling a small scale underwater vehicle to obtain high precision vehicle tracking data.

(2) Description of the Prior Art

In small scale underwater vehicles such as unmanned underwater vehicles (UUV's) and torpedoes, the vehicle deploys a periscope-like device to raise an antenna. The small scale underwater vehicle must operate near the surface and at a very slow speed in order to successfully receive and transmit data. The use of a periscope-type device is both expensive and potentially unreliable.

The following patents, for example, disclose data tracking systems tethered to a submarine or, but do not disclose data tracking systems and an ability to utilize radio frequency communications by deploying an underwater vehicle tether-free of the submarine.

U.S. Pat. No. 3,972,046 to Lombardi;

U.S. Pat. No. 4,227,479 to Gertler et al.;

U.S. Pat. No. 4,533,945 to Lauvray et al.; and

U.S. Pat. No. 5,379,034 to O'Connell.

Specifically, the patent to Lombardi discloses a primary buoy and a secondary buoy that deploys an RF antenna. The primary buoy remains tethered to the submarine and the secondary buoy remains tethered to the primary buoy. The secondary buoy primarily relies on its hydrodynamic shape to develop lift when towed. The Lombardi buoy does not have a launch configuration which allows untethered deployment of an unmanned underwater vehicle from the submarine, or a unique connection between the unmanned underwater vehicle and the buoy. Further, Lombardi does not contemplate the use of a single buoy.

The patent to Gertler et al. discloses a towed communications buoy having a hydrodynamically shaped body. The communications buoy, however, remains tethered to the submarine and is therefore restricted by the speed and depth of the submarine.

Lauvray et al. disclose a communications apparatus towed by a submarine that will rise to the surface at high speeds because of its high buoyancy and low hydrodynamic drag. The Lauvray device, however, also remains tethered to the submarine and is limited by that connection.

O'Connell discloses a device and method of communicating from an underwater vehicle by surfacing an antenna in a towed buoy without surfacing the underwater vehicle. The buoy relies soley on buoyancy to obtain lift and does not appear to rely on hydrodynamic forces. Further, the towing vehicle must slow to allow communication, thus limiting its use.

It should be understood that the present invention would in fact enhance the functionality of the above patents by utilizing an untethered unmanned underwater vehicle having a uniquely deployable single buoy connected thereto which uses hydrodynamic forces to raise the buoy for communication purposes.

SUMMARY OF THE INVENTION

Therefore it is an object of this invention to provide a system for obtaining global positioning and radio frequency communications for underwater vehicles.

Another object of this invention is to provide an unmanned underwater vehicle having a deployable communications buoy.

Still another object of this invention is to provide an untethered, unmanned underwater vehicle having a deployable data gathering and data transmitting buoy.

A still further object of the invention is to provide a low cost, highly reliable system for a small scale underwater vehicle to obtain high precision vehicle tracking data and to utilize radio frequency communications.

In accordance with one aspect of this invention, there is provided an antenna arrangement for a submerged submarine including an independently functioning underwater vehicle free of any tethered connection to said submarine, a buoy member having a hydrodynamic shape, an antenna mounted on the buoy member, the antenna enabling collection and transmission of global positioning data and radio frequency communications. A releasable connector securing the buoy member to the underwater vehicle in a primary non-deployed position, and a tether connection joins the buoy member to the underwater vehicle in a secondary deployed position. Release of the connector deploys the buoy member and the antenna such that the hydrodynamic shape of the buoy member raises the buoy member to a data collection and transmission position at a surface of the water.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
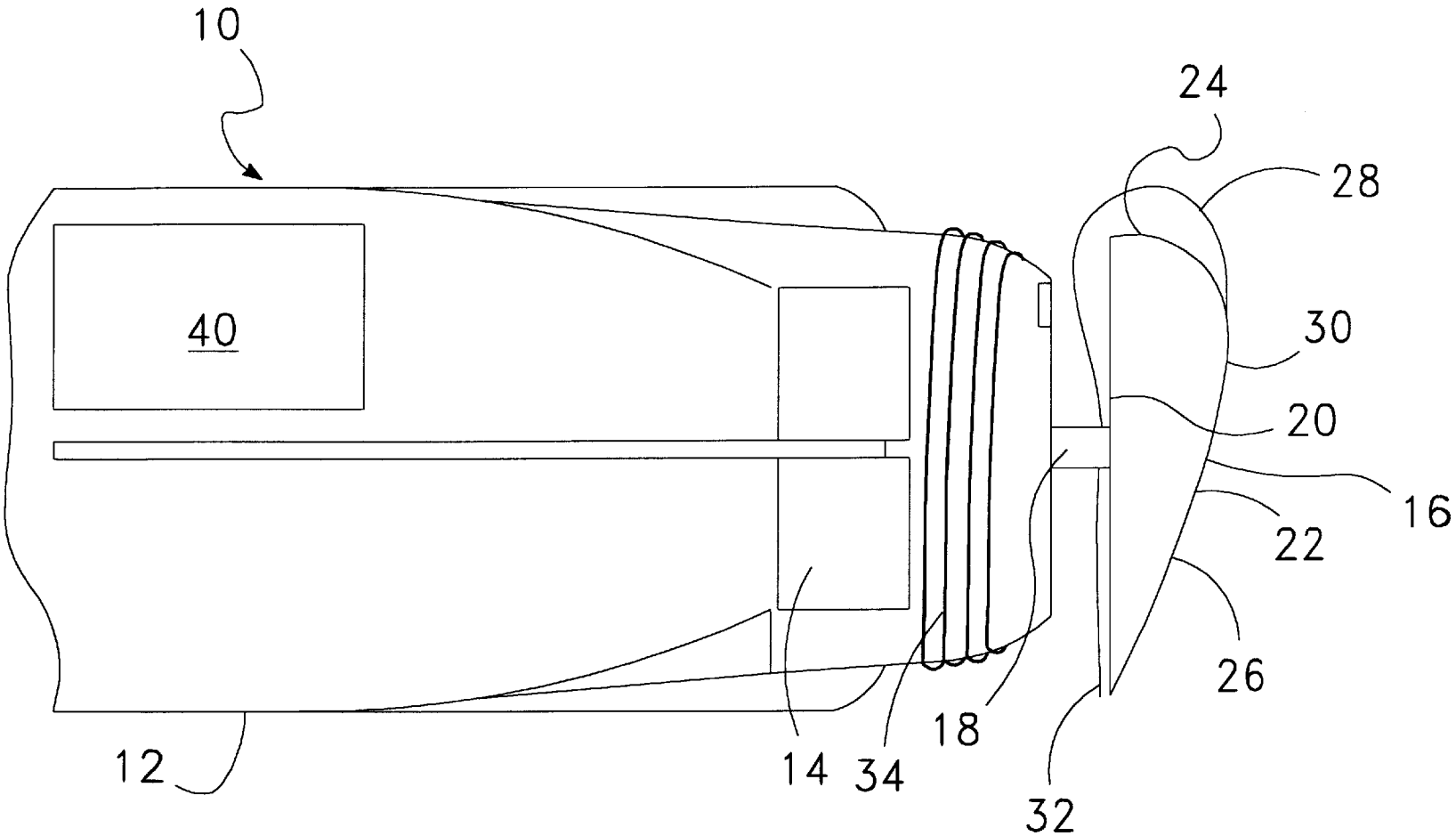
FIG. 1 is a side view of an unmanned underwater vehicle in combination with a deployable buoy according to a first preferred embodiment of the present invention.

Referring first to FIG. 1, there is illustrated a rear section of an underwater vehicle 10 such as an unmanned underwater vehicle, a torpedo or the like. The underwater vehicle 10 is generally of a known type including a body. portion 12 housing certain communications equipment 40 and a propulsion device 14 for propelling the vehicle 10 through the water in programmed directions and speeds.

A buoy 16 is shown connected to the underwater vehicle 10 by a separation device 18. More particularly, the buoy 16 includes a planar undersurface 20, a curved upper surface 22, a rounded nose 24 between the undersurface 20 and the upper surface 22, and a tapered tail portion 26. In addition, the buoy 16 includes an antenna 28 having a base portion 30 and a free end 32. The antenna 28 is of the type that receives global positioning data and will receive and transmit radio frequencies. The base portion 30 of the antenna 16 is mounted on the buoy 16 in the vicinity of the nose portion 24 and on the curved upper surface 22 of the buoy 16.

While in a storage position, the antenna 28 is captured by the separation device 18 such that the antenna 28 is maintained between the planar undersurface 20 of the buoy 16 and a body portion 12 of the underwater vehicle 10. The separation device 18 may be any suitable underwater connector which is not subject to deterioration as a result of prolonged underwater exposure. Further, the separation device 18 will release the buoy 16 and hence the antenna 28 upon receipt of a signal from the underwater vehicle 10. Separation device 18 can be a solenoid or other actuator known in the art. When the buoy 16 is released from the underwater vehicle 10 at the separation device 18, the antenna 28 will spring free thus erecting the antenna 18 for use in communications.

Figure 2:
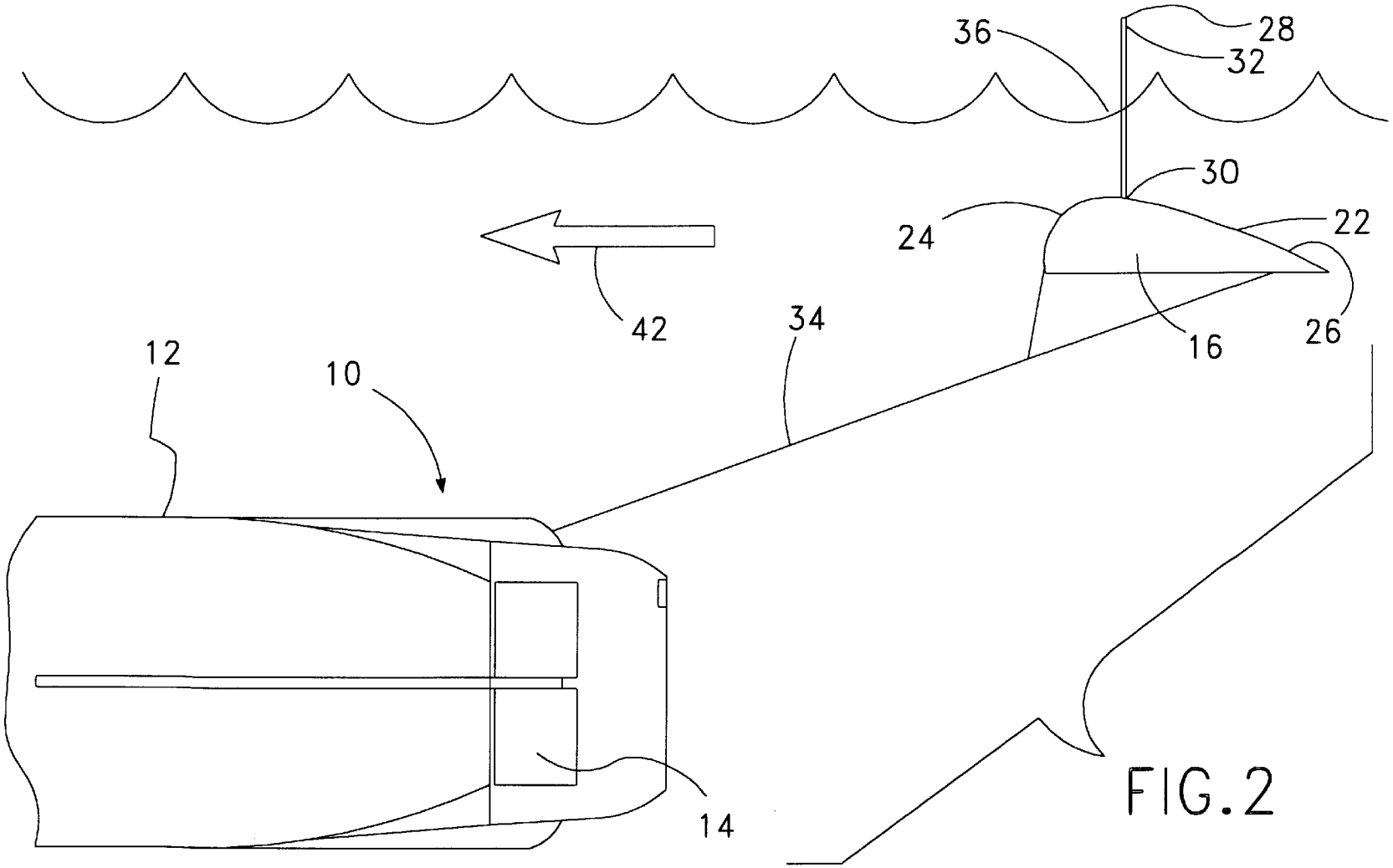
FIG. 2 is a side schematic view of a deployed buoy in relation to the unmanned underwater vehicle and a surface of the water including a tether arrangement of the buoy to the underwater vehicle.

Referring now to FIG. 2, it can be seen that the buoy 16 is connected to the underwater vehicle 10 by an elongated tether 34. The tether 34 includes an electrical wire capable of transmitting data. The underwater vehicle 10 may travel at any given or necessary speed due to its independence from a submarine (not shown) from which it was initially launched. The buoy 16 uses forward velocity to generate lift to raise the antenna 28 above a surface 36 of a body of water. Velocity of vehicle 10 is indicated by arrow 42. Antenna 28 may be surfaced for extended periods of time, thereby enabling extended communications and data collection to an extent that has not previously been known in the art. In other words, the speed and location of the buoy 16 and antenna 28 combination is completely independent of the submarine and is instead directed solely by the underwater vehicle 10.

In addition, the length of the tether 34 can be adjusted according to specific needs, thereby offering additional advantages not previously known. More specifically, the underwater vehicle 10 may have a certain depth and speed that are known to be optimum operating conditions for the underwater vehicle. With this, the length of the tether 34 can be determined to permit the underwater vehicle 10 to operate at those optimum conditions. Thus, restrictions required by known devices tethered to the submarine are not a factor in the present invention.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An antenna system for a submarine deployed vehicle, comprising:

an independently functioning underwater vehicle;

a buoy member having a hydrodynamic shape;

an antenna mounted on said buoy member, said antenna enabling communications;

a releasable connector positioned on an aft end of said underwater vehicle securing said buoy member aft of said underwater vehicle in a primary non-deployed position; and a tether connecting said buoy member to said underwater vehicle in a secondary deployed position;

wherein release of said connector deploys said buoy member from said primary non-deployed position to said secondary deployed position such that the hydrodynamic shape of said buoy member raises said buoy member to a position at a surface of the water.

2. The system according to claim 1, wherein said buoy member includes a planar undersurface, a curved upper surface, a curved nose portion connecting the planar undersurface to the curved upper surface, and a tapered tail portion.

3. The system according to claim 1, wherein said antenna includes a base portion mounted to the buoy member and a free end opposite the base portion.

4. The system according to claim 3, wherein the free end of said antenna wraps around the nose portion of said buoy and is secured by said releasable connector in said primary non-deployed position.

5. The antenna according to claim 3, wherein the free end of said antenna is erect in said secondary deployed position.

6. The antenna according to claim 1, wherein said releasable connector is primarily mounted to said underwater vehicle.

7. The antenna according to claim 1, wherein said releasable connector is primarily mounted to said buoy member.

8. The system according to claim 1, wherein said independently functioning underwater vehicle is deployed from a submarine launch tube.

9. The system according to claim 1, wherein said antenna is constructed of an elastic material and has a free end and a base portion, said antenna free end wrapping around said buoy and being secured by said releasable connector in said primary non-deployed position, and said antenna free end standing away from said buoy in said secondary deployed position.

10. The system according to claim 1, wherein said tether is wound around said underwater vehicle in said primary non-deployed position.

11. A communication device for an underwater vehicle comprising:

a releasable connector position on said underwater vehicle;

a buoy joined to said releasable connection in a predeployment configuration, said buoy having a hydrodynamic shape;

a tether joined between said buoy and said underwater vehicle and having communication members therein, said tether retaining said buoy in a deployed configuration; and an antenna disposed on said buoy and operationally joined with said tether communication members, said antenna being made from an elastic material, wrapped around said buoy and retained by said releasable connector in said predeployment configuration, and said antenna extending out from a surface of said buoy in said deployed configuration.

12. The device of claim 11, wherein forward motion of said underwater vehicle acts with said buoy hydrodynamic shape to cause said buoy to move toward and environmental water surface in said deployed configuration.

13. The device of claim 12, wherein said tether is wrapped around said underwater vehicle in said predeployment configuration.

* * * * *